United States Patent [19]

Russo

[11] Patent Number: 5,004,131

[45] Date of Patent: Apr. 2, 1991

[54] MOLTEN METAL SLIDE GATE VALVE

[75] Inventor: Thomas J. Russo, Kingsville, Md.

[73] Assignee: Bethlehem Steel Corporation, Bethlehem, Pa.

[21] Appl. No.: 509,683

[22] Filed: Apr. 16, 1990

[51] Int. Cl.[5] ..... B22D 41/08

[52] U.S. Cl. ..... 222/600; 222/603

[58] Field of Search ..... 222/600, 603; 266/217, 266/220, 265

[56] References Cited

U.S. PATENT DOCUMENTS

| | | | |
|---|---|---|---|
| 3,684,267 | 8/1972 | Andrzejak | 266/220 |
| 3,809,146 | 5/1974 | Andrzejak | 164/66 |
| 3,887,117 | 6/1975 | Fehling | 222/603 |
| 3,918,613 | 11/1975 | Shapland | 222/148 |
| 4,131,219 | 12/1978 | Hind | 222/603 |
| 4,179,046 | 12/1979 | Jeschke | 222/603 |
| 4,365,731 | 12/1982 | Fehling | 222/603 |
| 4,576,317 | 3/1986 | Wenger | 222/600 |
| 4,583,721 | 4/1986 | Arakawa | 222/603 |
| 4,789,086 | 12/1988 | Rothfuss | 222/603 |

*Primary Examiner*—S. Kastler, III

[57] ABSTRACT

A molten metal slide gate valve for use on a ladle or tundish. The slide gate valve uses a stationary upper plate having a groove formed in its lower face around the periphery of the plate. The groove is connected to a source of a nonoxidizing gas under pressure to provide a gas seal around the molten metal orifices in the slide gate valve and prevent the aspiration of air into the molten metal orifices during discharge of the molten metal from the ladle or tundish.

2 Claims, 1 Drawing Sheet

MOLTEN METAL SLIDE GATE VALVE

BACKGROUND OF THE INVENTION

This invention relates to the pouring of molten metals from a ladle into a receiving vessel such as a mold or a tundish of a continuous casting facility. It relates particularly to improvements in the construction of a sliding gate molten metal valve commonly used to control the flow of molten metal from the bottom of a ladle or tundish.

Sliding gate molten metal valves generally are comprised of a stationary upper plate having an orifice, a reciprocable lower slide plate having an orifice and movable in contact with the underside of the upper plate to bring the orifices in the two plates in and out of registry with each other to open and close the valve. A discharge nozzle is mounted below the lower sliding plate in alignment with the lower plate orifice to direct the molten metal into the mold or tundish.

While the lower slide plate is held tightly against the underside of the upper plate with springs, it has been noted that air is capable of being drawn into the orifices in the plates and causes oxidation of the molten metal as it is being discharged through the sliding gate valve. If the molten metal is aluminum-killed steel, the aluminum in the steel will be oxidized forming particles of alumina which adhere to the discharge nozzle or remain in the steel as harmful inclusions.

Past attempts to prevent the infiltration of air into the sliding gate valve or by flooding the area around the plates have not been successful in preventing the infiltration of air into the plate orifices.

SUMMARY OF THE INVENTION

It is therefore an object of this invention to provide a slide gate molten metal valve which reduces the infiltration of air into the orifices of the slide gate plates.

It is a further object of this invention to provide apparatus that will reduce the amount of aluminum oxide in steel as it is poured from a ladle into a continuous casting machine.

I have discovered the foregoing objects can be attained by a slide gate valve having a stationary upper refractory plate with a molten metal orifice, a reciprocable lower refractory slide plate with a molten metal orifice which plate is movable in contact with the bottom face of the upper refractory plate member. The bottom face of the upper refractory plate member has a shallow groove extending around the entire periphery of the bottom face which is connected to a source of nonoxidizing gas to supply the gas to the groove.

DESCRIPTION OF A PREFERRED EMBODIMENT

Figure 1:
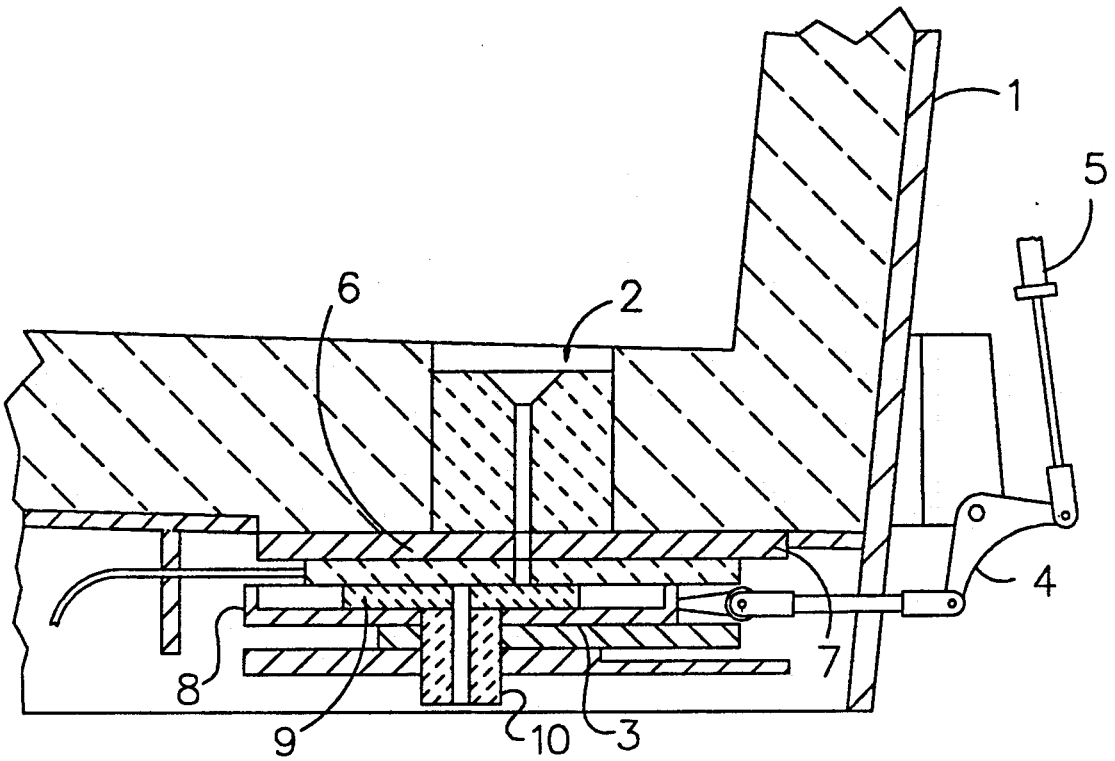
FIG. 1 is a sectional elevational view of a slide gate valve of this invention.

Referring to FIG. 1, molten steel contained in a ladle 1 is discharged through a refractory nozzle 2 and a sliding gate valve 3 operated by linkage 4 and a hydraulic cylinder 5. Slide gate valve 3 comprises a steel base plate 6 attached to the bottom of ladle 1 and retains nozzle 2. A stationary refractory upper plate 7 is secured to base plate 6. A molten metal orifice in line with nozzle 2 allows for the flow of molten metal from nozzle 2 through the upper plate 7.

A steel frame 8 holds a reciprocable lower refractory slide plate 9 which also has a molten metal orifice in alignment with a lower refractory nozzle 10 secured in steel frame 8. As illustrated in FIG. 1, movement of the lower refractory slide plate 9 back and forth will cause the molten metal orifices in upper plate 7 and lower slide plate 9 to move in and out of registry with each other and thereby control the flow of molten metal through the slide gate valve 3.

While springs (not shown) are used to urge the top surface of sliding plate 9 tightly against the bottom face of the upper plate 7, it has been observed that the contact between the two plates is not sufficient to prevent significant amounts of air to be drawn into the molten metal orifices in the plates where the air then oxidizes the molten metal as it is being discharged through the sliding gate valve 3.

Figure 2:
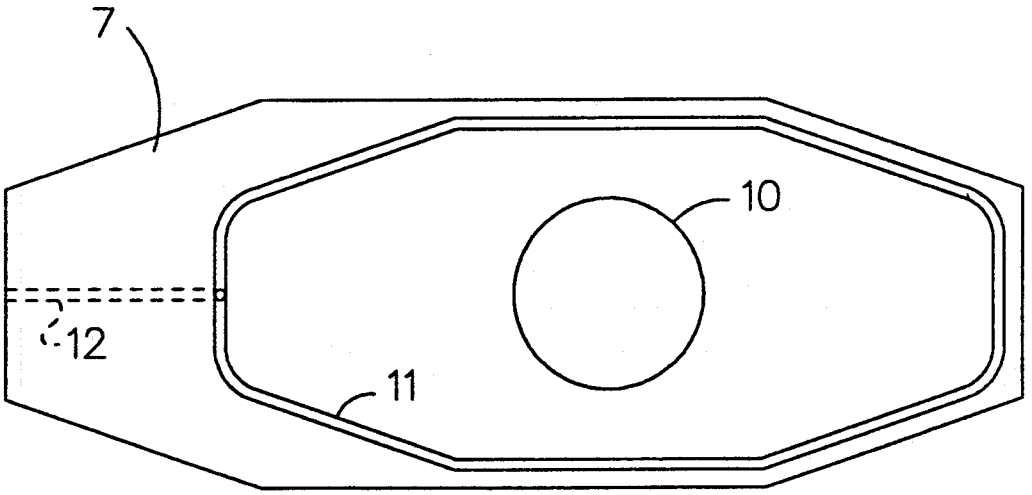
FIG. 2 is a bottom view of the stationary top plate of the slide gate valve of this invention.

FIG. 2 illustrates the bottom face of the stationary upper plate 7 of our invention with the molten metal orifice 10 centrally located therein. Extending around the periphery of the upper plate 7 is a shallow, continuous groove 11 of length sufficient to surround the molten metal orifice of sliding plate 9 in all of its adjustable in and out positions. Groove 11 has a passageway 12 drilled into the end of upper plate 7 which permits it to be attached to a source of a pressurized nonoxidizing gas, such as argon. The introduction of the nonoxidizing gas into the groove 11 during casting has greatly reduced the infiltration of air into the molten metal orifices of plates 7 and 9.

Specific Example. A modified upper plate 7 was installed in a groove 11 around the bore in which argon was injected to a rate of 100 cfh. The drop in aluminum and pick-up of nitrogen from ladle to tundish was measured to determine the effectiveness of argon shrouding of the ladle gate to prevent reoxidation. The ladle sample was a production sample taken immediately after the last test at the ladle treatment station. The tundish samples were removed with "bomb" samplers from the region adjacent to the ladle shroud. The tundish was sampled three times per heat, typically at 400,000 and 250,000 and 100,000 lbs. ladle weight.

The first set of tests was taken on Heat 422P922. The gate was taken apart after one heat and the plate was examined for cracks, wear or other defects. No mechanical defects were noted. The plates remained for three heats in the gate during the second test series (421P239, 421P242, 422P945). Again, the plates showed no unusual wear after each of the heats.

A first indication that argon was aspirated by the gate was given by the increase of boiling around the ladle shroud as soon as the argon to the gate was turned on. The boiling caused a higher than usual consumption of tundish cover material. The results of the chemical analysis are compiled in the attached table. The nitrogen pick-up range from 0 to 3 ppm, indicating an effective shrouding and lack of reoxidation.

While this invention was developed for a two plate slide gate valve, it could be adapted to a three plate slide gate valve with grooves in the upper and lower plate of the three plate slide gate valve.

I claim:

1. A slide gate valve for controlling the flow of molten metal comprising a stationary upper refractory plate member having a molten metal orifice, a reciprocable lower refractory slide plate having a molten metal orifice and movable in contact with the bottom face of said upper refractory plate member, the bottom face of said upper refractory plate member having a shallow open groove extending around the entire periphery of said molten metal orifice and means for introducing a flow of a nonoxidizing gas into said groove.

2. The slide gate valve of claim 1 in which the means for introducing a flow of nonoxidizing gas into said groove is a passageway drilled in the end of the upper refractory plate member.

* * * * *

Disclaimer and Dedication 5,004,131—*Thomas J. Russo*, Kingsville, Md. MOLTEN METAL SLIDE GATE VALVE. Patent dated Apr. 2, 1991. Disclaimer filed May 12, 1992, by the assignee, Bethlehem Steel Corp.

Hereby enters this disclaimer to claims 1 and 2 of said patent and dedicates to the public the remaining term.